United States Patent [19]

Nakajima

[11] Patent Number: 4,486,250

[45] Date of Patent: Dec. 4, 1984

[54] COPPER-BASED ALLOY AND METHOD FOR PRODUCING THE SAME

[75] Inventor: Takashi Nakajima, Kanagawa, Japan

[73] Assignee: Mitsubishi Denki Kabushiki Kaisha, Tokyo, Japan

[21] Appl. No.: 533,160

[22] Filed: Sep. 19, 1983

Related U.S. Application Data

[63] Continuation of Ser. No. 399,120, Jul. 16, 1982, abandoned.

[30] Foreign Application Priority Data

Jul. 23, 1981 [JP] Japan ..... 56-115585

[51] Int. Cl.[3] ..... C22C 9/02; C22F 1/08

[52] U.S. Cl. ..... 148/433; 148/11.5 C; 420/472

[58] Field of Search ..... 148/11.5 C, 412, 414, 148/433, 435; 420/472, 473, 485, 499

[56] References Cited

U.S. PATENT DOCUMENTS

| | | | |
|---|---|---|---|
| 2,309,102 | 1/1943 | Crampton et al. | 148/412 |
| 2,804,408 | 8/1957 | Gregory | 148/11.5 C |
| 3,930,894 | 1/1976 | Shapiro et al. | 148/12.7 C |
| 4,337,089 | 6/1982 | Arita et al. | 148/12.7 C |

*Primary Examiner*—Peter K. Skiff

*Attorney, Agent, or Firm*—Oblon, Fisher, Spivak, McClelland & Maier

[57] ABSTRACT

Copper-based alloy consists essentially of 1.7% to 2.5% of tin, 0.03% to 0.35% of phosphorus, 0.1% to 0.6% of nickel, and remainder of copper and unavoidable impurities, the percentage ratio being all by weight.

2 Claims, 4 Drawing Figures

SPECIMEN No. 3
GRAIN SIZE 3μ

SPECIMEN No. 8
GRAIN SIZE 20μ

COPPER-BASED ALLOY AND METHOD FOR PRODUCING THE SAME

This application is a continuation of application Ser. No. 399,120, filed July 16, 1982, abandoned.

BACKGROUND OF THE INVENTION

1. Field of the Invention

This invention relates to a copper-based alloy and a method for producing the same. More particularly, it is concerned with a copper-based alloy for use as component parts for electrical apparatuses and appliances, in particular, as a semiconductor lead frame.

2. Description of the Prior Art

The material for the semiconductor lead frame is required to have various properties such as high electrical conductivity, high mechanical strength, repetitive being capability, soldering capability, plating capability, heat-resistant property, low thermal expansion coefficient, and so forth.

Heretofore, an "Fe-Ni series 42 alloy" with high mechanical strength and less thermal expansion has been principally used as the material for the semiconductor lead frame. In recent years, however, this conventional trend has changed remarkably due to preference on the part of users of high output, multi-function, high productivity, and a low cost in the semiconductor device, as the result of which use of copper-based alloy which is inexpensive and possesses high electrical conductivity has become increased.

Ideal yardsticks for the characteristics of the material for the semiconductor lead frame in respect to a tensile strength, elongation, and electrical conductivity are, in general, said to be 50 kg/mm$^2$ and above for the tensile strength, 10% and above for the elongation, and 50% IACS and above for the electrical conductivity. However, nothing in the existing materials which have so far been known perfectly satisfies these standard values, and there have so far been put to practical use only the Fe-Ni series 42 alloy and phosphor bronze with predominant mechanical strength and repetitive bending property, and various copper-based alloys composed of copper as the principal constituent and a very small amount of alloying elements added to it, with emphasis being placed on the electrical conductivity and market price of the article.

However, these conventional 42 alloy and phosphor bronze have low electrical conductivity, and are inevitably expensive due to high cost of the constituent elements. On the other hand, the copper-based alloys composed of copper as the principal constituent, to which a very small quantity of alloying elements is added, are not satisfactory in their tensile strength, repetitive bending property, heat-resistant property, and so on.

SUMMARY OF THE INVENTION

In view of the abovementioned disadvantages in the conventional 42 alloy, phosphor bronze, and copper-based alloys, it is a primary object of the present invention to provide an improved copper-based alloy having excellent properties suitable for use as the component parts in various electrical apparatuses and appliances.

It is another object of the present invention to provide an excellent copper-based alloy suitable for use as the component parts of electrical apparatuses and appliances, particularly as the material for semiconductor lead frame, which is cheaper than 42 alloy or phosphor bronze and possesses mechanical strength and repetitive bending property comparable to these conventional alloys, and further has relatively high electrical conductivity.

According to the present invention, in one aspect of it, there is provided a copper-based alloy which consists essentially of 1.7% to 2.5% of tin, 0.03% to 0.35% of phosphorus, 0.1% to 0.6% of nickel, and remainder of copper and unavoidable impurities, the percentage ratio being all by weight.

According to the present invention, in another aspect of it, there is provided a method for producing a copper-based alloy of the above-mentioned composition, which comprises subjecting said alloy to heat-treatment at a temperature range of from 400° C. to 750° C. to render the crystal grain size to be 10 microns or below; and making the ultimate reduction ratio of said alloy to be in a range of from 20 to 60%.

The foregoing objects, other objects as well as specific composition and method of producing the copper-based alloy according to the present invention will become more apparent and understandable from the following detailed description thereof, when read in conjunction with the accompanying drawings.

DETAILED DESCRIPTION OF THE PREFERRED EMBODIMENTS

Figure 1:
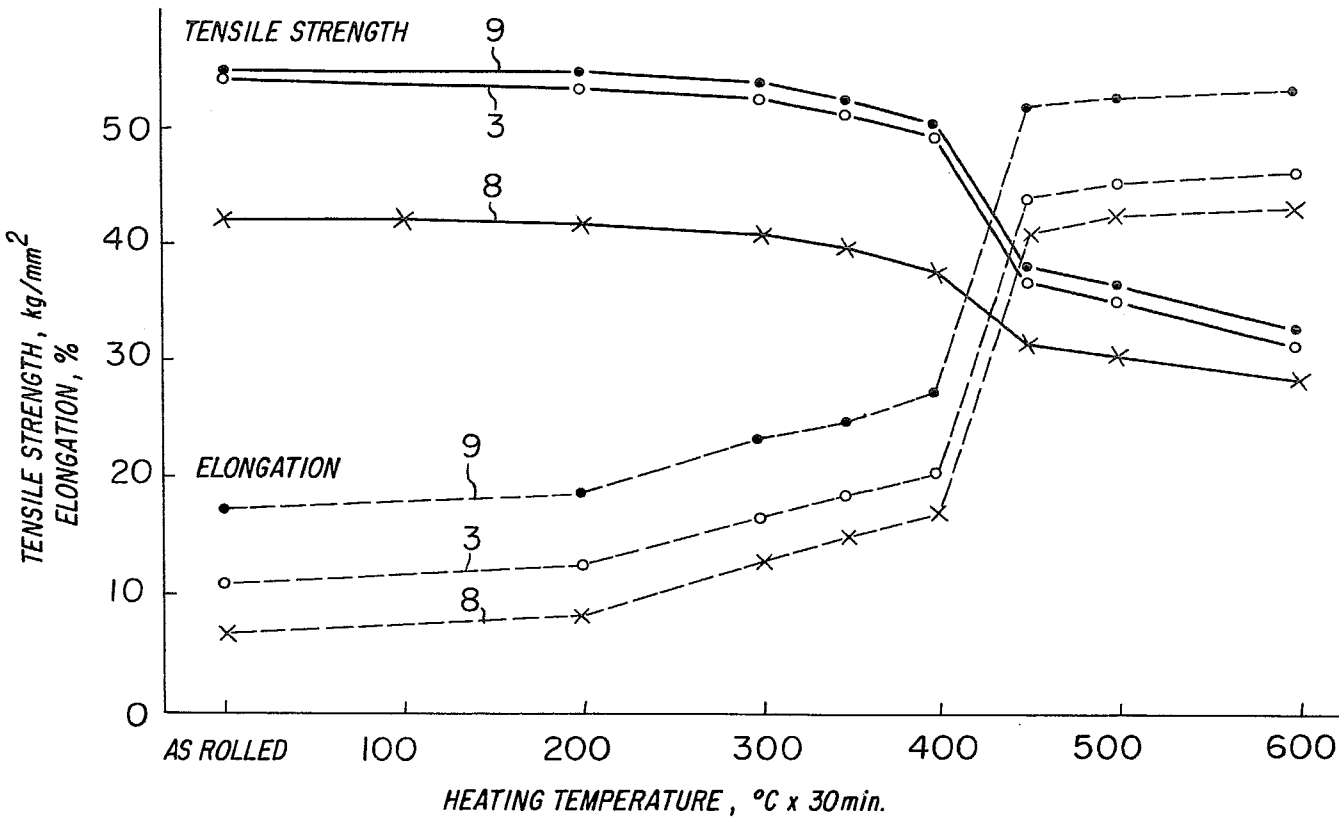
FIGS. 1 and 2 are graphical representations comparing the characteristics of the copper-based alloy according to the present invention and the conventional alloys.

In the following, the present invention will be described with reference to preferred embodiments thereof.

The copper-based alloy according to the present invention consists of 1.7% to 2.5% by weight of tin (Sn), 0.03% to 0.35% by weight of phosphorus (P), 0.1% to 0.6% by weight of nickel (Ni), and remainder of copper (Cu) and unavoidable impurities. The reason for limiting the range of each and every alloying component is as follows. As to tin (Sn), its lower limit of 1.7% by weight has been determined as the minimum required quantity to obtain the general idealistic levels of its mechanical strength and elongation in consideration of the effect to be derived from addition of nickel (Ni), while its upper limit of 2.5% by weight is determined in view of its electrical conductivity and price aspect. As for nickel (Ni), the quantity of 0.1% by weight, which enables the crystal grains of the Cu-Sn alloy in the abovementioned component range to be made fine and the mechanical strength to be improved, has been set as its lower limit, and the quantity of 0.6% has been set as its upper limit from the cost aspect, same as in the case of tin (Sn). As for phosphorus (P), the quantity of 0.03% by weight, at which the de-oxygenating effect can be obtained, has been set as its lower limit, and the quantity of 0.35% by weight has been made the upper limit from the standpoint of electrical conductivity of the resulting alloy.

In the following, explanations will be given as to the method for producing the copper-based alloy according to the present invention. The casting is done by an ordinary melting method to thereby produce an ingot slab. Subsequent to production of the ingot slab, cold rolling and annealing are repeatedly performed. As soon as the slab reaches a predetermined gauge, a heat-treatment is conducted at a temperature range of from 400° C. to 750° C. to render the crystal grain size in the micro-structure of the rolled article to be 10 microns or below, and the ultimate ratio of reduction is made between 20 and 60%. In this case, the temperature range for the heat-treatment is such that the crystal grain size may be made sufficiently fine, in addition to the necessary condition for annealing and recrystallizing the copper-based alloy of the abovementioned composition, whereby a stable fine crystal structure with a minor content of nickel can be readily obtained. For instance, outside the abovementioned temperature range, the microstructure is difficult to obtain, so that improvement in the level of mechanical strength of the alloy due to minification of the crystal grains becomes impossibly attained. As for the ultimate ratio of reduction of 20% to 60%, it indicates the maximum level of the mechanical strength to maintain the minimum strength level and the repetitive bending workability required of the semiconductor lead frame.

In the following, the present invention will be explained in specific details with reference to several experimental examples. The following Table 1 shows the compositional ratio and the ultimate ratio of reduction of the alloy produced by the experiments.

TABLE 1

| Specimen No. | Sn | Ni | P | Cu | Fe | Ultimate reduction ratio (%) | Remarks |
|---|---|---|---|---|---|---|---|
| 1 | 2.05 | — | 0.04 | * | — | 37 | comparative alloy |
| 2 | 2.03 | 0.11 | 0.04 | * | — | 37 | inventive alloy |
| 3-1 | 2.06 | 0.20 | 0.03 | * | — | 37 | inventive alloy |
| 3-2 | | | | | | 11 | |
| 3-3 | | | | | | 21 | |
| 3-4 | | | | | | 50 | |
| 3-5 | | | | | | 60 | |
| 3-6 | | | | | | 80 | |
| 4 | 2.05 | 0.39 | 0.04 | * | — | 37 | inventive alloy |
| 5 | 1.23 | 0.21 | 0.07 | * | — | 37 | comparative alloy |
| 6 | 1.21 | 0.57 | 0.07 | * | — | 37 | " |
| 7 | 1.24 | 0.96 | 0.07 | * | — | 37 | " |
| 8 | 1.25 | — | 0.09 | * | — | 37 | comparative alloy (CDA 505 alloy) |
| 9 | 4.05 | — | 0.07 | * | — | 37 | comparative alloy (JIS C5101 alloy) |
| 10 | — | 42.08 | — | — | * | 37 | comparative alloy (42 alloy) |

* = remainder

The specimens were produced by first adjusting the compositional ratio of each component element, and then melting the mixture in a high frequency induction heating furnace, followed by pouring the melt into a metal mold, whereby specimen ingots of different compositional ratios were obtained. Each ingot was then subjected to repeated cold rolling and annealing so that it may be brought closer to a predetermined slab thickness with the ultimate reduction ratio as indicated in Table 1 above. Subsequently, specimens were taken from the thus obtained materials, and measured for various physical characteristics, the results of which are shown in the following Table 2.

TABLE 2

| Specimen No. | Tensile strength (kg/mm²) | Elongation (%) | Hardness Hv (0.5) | Repetitive Bending Capability (number of times)* Bending radius 0.25 mm | Repetitive Bending Capability (number of times)* Bending radius 0.5 mm | Electrical Conductivity (% IACS) |
|---|---|---|---|---|---|---|
| 1 | 49.5 | 12.0 | 155 | 5.9 | 9.5 | 28.9 |
| 2 | 53.5 | 12.0 | 162 | 7.1 | 12.6 | 29.3 |
| 3-1 | 54.5 | 11.3 | 165 | 7.4 | 13.1 | 30.3 |
| 3-2 | 42.3 | 33.4 | 138 | 7.8 | 15.6 | 30.2 |
| 3-3 | 47.6 | 25.0 | 151 | 7.6 | 14.2 | 30.1 |
| 3-4 | 60.0 | 8.0 | 188 | 7.4 | 9.8 | 30.3 |
| 3-5 | 65.0 | 6.0 | 206 | 6.7 | 8.6 | 30.3 |
| 3-6 | 71.0 | 4.2 | 220 | 4.2 | 6.3 | 30.2 |
| 4 | 56.8 | 10.5 | 171 | 7.6 | 13.4 | 31.9 |
| 5 | 48.0 | 7.0 | 146 | 5.4 | 8.5 | 42.8 |
| 6 | 49.8 | 6.5 | 150 | 5.8 | 9.3 | 43.0 |
| 7 | 50.5 | 6.3 | 152 | 5.8 | 9.4 | 43.0 |
| 8 | 43.5 | 8.5 | 140 | 5.3 | 8.3 | 42.6 |
| 9 | 55.0 | 17.3 | 176 | 9.0 | 15.3 | 17.0 |
| 10 | 63.5 | 18.6 | 195 | 9.3 | 15.9 | 5.1 |

* = Method of measuring the number of times of repetitive bending (uni-directional bending by 90°; single reciprocal bending for one time; cross-sectional area of specimen - 0.125 cm²; load applied - 250 g)

Figure 2:
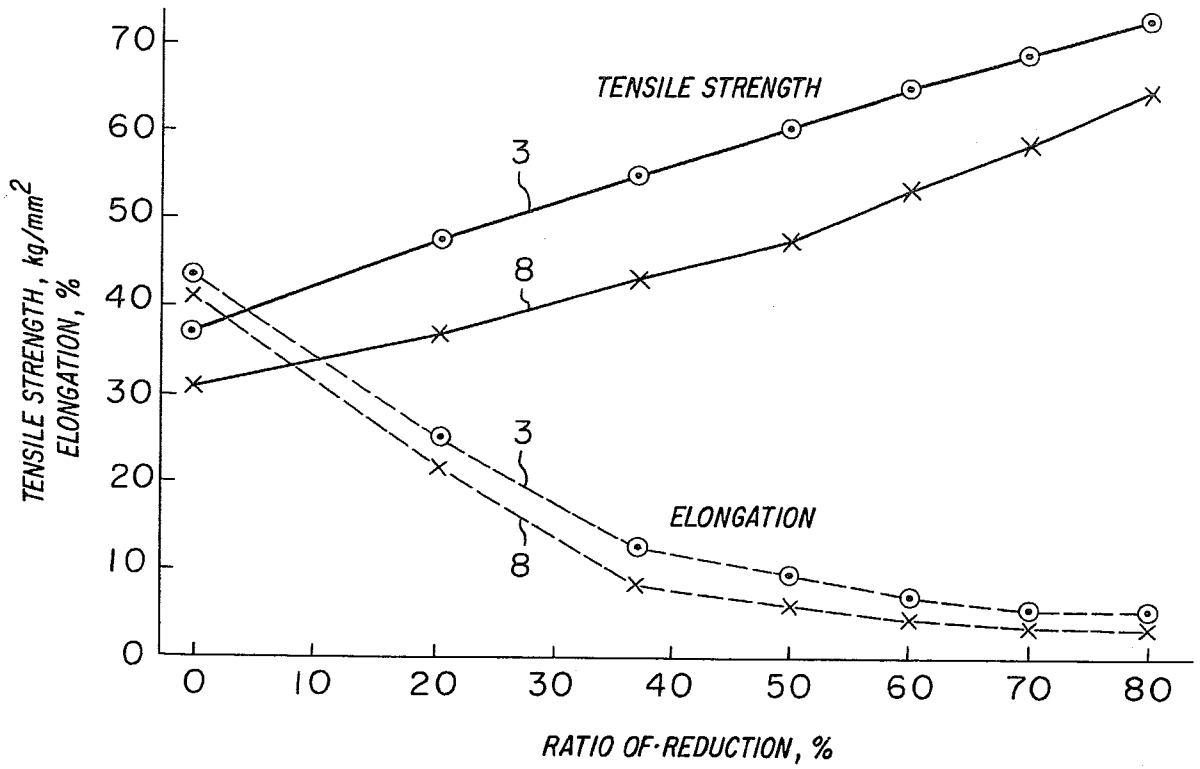

The abovementioned experimental results are represented by graphs in FIGS. 1 and 2, respectively showing a relationship among the heating temperature, tensile strength and elongation, and a relationship among the reduction ratio, tensile strength and elongation.

From FIGS. 1 and 2 as well as Table 2, it can be seen that the mechanical characteristics, repetitive bending characteristics, etc. of the alloy according to the present invention is remarkably superior to the comparative specimen No. 8, is equal to the comparative specimens No. 9 and No. 10, and is further excellent in its electrical conductivity to these comparative specimens, and its heat-resistant property is equal to the comparative specimen No. 9.

As to the specimens No. 5, No. 6 and No. 7, they are for comparison with the specimen No. 8 (conventional alloy—CDA 505) in respect to the effect of the nickel addition. As shown in Table 2, the effect of nickel in the alloy improves the tensile strength, taken as an example, by about 5 kg/mm² or so, when compared with the conventional alloy. From the Table and the graphical representations, it is also seen that influence on the electrical conductivity is less in this range of the nickel content. However, these comparative specimens No. 5, No. 6 and No. 7 do not still attain the tensile strength of 50 kg/mm² and above, which is an idealistic level of the tensile strength, hence they were exempted from the objects for the intended use in the present invention in spite of their having the remarkable effect of nickel addition. Further, it is seen from Table 2 that comparison of the specimen No. 3 with the conventional alloy in respect of the tensile strength level and the repetitive bending property reveals that the strength level is low at the ultimate reduction ratio of 11%, and that the repetitive bending property becomes abruptly deteriorated when the ultimate ratio exceeds 60%. Therefore, the ultimate reduction ratio has been limited to a range of 20 to 60% from the viewpoint of the required characteristics for the semiconductor lead frame.

Figure 3A:
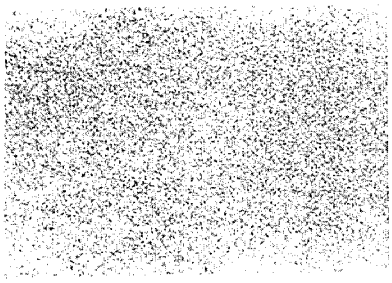
FIGS. 3(*a*) and 3(*b*) are respectively optical micrographs (×100 in magnification) showing the microstructure of the alloy according to the present invention and that of the conventional alloy.
Figure 3B:
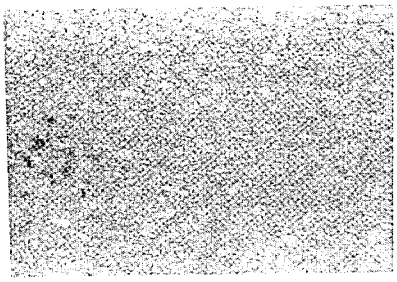

FIGS. 3*a* and 3*b* show optical micrographs (×100 in magnification) of the alloy according to the present invention and the conventional alloy, respectively, wherein FIG. 3*a* is the micrograph of specimen No. 3 (the alloy of the present invention) and FIG. 3*b* is the micrograph of the specimen No. 8 (the conventional alloy). From these micrographs in FIGS. 3*a* and 3*b*, it is well proved that the microstructure of the alloy according to the present invention has been highly minified by addition of nickel to the alloying components.

As stated in the foregoing, owing to the minification effect of the crystal grains by addition of nickel, the copper-based alloy according to the present invention attains various mechanical characteristics and repetitive bending characteristics comparable to phosphor bronze or, further, 42 alloy, and the heat-resistant property equal to phosphor bronze. Furthermore, the alloy has its electric conductivity which is relatively as high as approximately 30%.

While the minification of the crystal grains can be regulated to a certain extent by refining the quality of alloy (such as by rolling, annealing etc.), it is very difficult to attain the ultra-minification of the crystal grains to such satisfactory extent as in the alloy of the present invention.

From the afore-described results of experiments, the copper-based alloy according to the present invention is composed of the component elements which are relatively inexpensive in price, yet it possesses the mechanical strength which is equal to that of the conventional phosphor bronze or 42 alloy, and moreover a relatively high electrical conductivity. In view of such excellent property the alloy of the present invention can sufficiently take the place of the conventional phosphor bronze or 42 alloy as the material for the semiconductor lead frame. In other aspect, the alloy according to the present invention can be sufficiently used in place of the conventional alloys containing therein a small quantity of other additional element to copper, emphasizing the electrical conductivity, for improving reliability in respect of its mechanical strength.

Further, in view of its having very fine crystal grains in the micro-structure, it is presumed that the copper-based alloy of the present invention is excellent in its shaping property in comparison with the conventional alloy.

While the alloy of the present invention exhibits the optimum characteristics as the material for the semiconductor lead frame, it can be said to be sufficiently useful also as the material for other component parts in various other electrical apparatuses and appliances owing to its having high mechanical strength and high electrical conductivity as already mentioned in the foregoing. For instance, in case of using the alloy of the present invention for a spring material in general, it can be subjected to a low temperature annealing in a range of from 150° C. to 350° C., after the ultimate finishing work for removing the work distortion, as is the case with other spring materials, thereby improving the spring performance and bending workability thereof.

Incidentally, in connection with the effect of nickel addition, it may be worthy of note that some patent literatures describe that sufficient effect of crystal grain minification cannot be obtained unless 0.5% by weight and above of nickel is added to the alloying components. However, the alloy of the present invention is recognized to show a satisfactory effect, even if the nickel content is 0.1% by weight, hence the technical content of the present invention is totally different from these known arts.

Although, in the foregoing, the present invention has been described in reference to several preferred experimental embodiments, it should be understood that the present invention is not restricted to these examples alone, but any changes and modifications in the compositional ratio and the heat-treatment conditions may be made within the spirit and scope of the invention as set forth in the appended claims.

I claim:

1. An annealed copper-based alloy which consists essentially of 1.7% to 2.5% of tin, 0.03% to 0.35% of phosphorus, 0.11% to 0.39% of nickel, and remainder of copper and unavoidable impurities, the percentage ratio being all by weight, wherein said alloy has a crystal grain size of 10 microns or below and wherein said alloy exhibits a tensile strength of about 45 $Kg/mm^2$ or greater, an elongation of about 6% or greater, an electrical conductivity of about 30% IACS or greater and an ultimate reduction ratio of from about 20% to about 60%.

2. A method for producing a copper-based alloy which exhibits a tensile strength of about 45 $Kg/mm^2$ or greater, an elongation of about 6% or greater, an electrical conductivity of about 30% IACS or greater and an ultimate reduction ratio in the range of about 20% to about 60% and has a crystal grain size of 10 microns or below by the process consisting essentially of the step of subjecting a cast ingot of the alloy of the composition 1.7% to 2.5% of tin, 0.03% to 0.35% of phosphorus, 0.11% to 0.39% of nickel, and remainder of copper and unavoidable impurities, the percentage ratio being all by weight, to cold reduction followed by annealing heat treatment at a temperature range of about 400° C. to about 750° C., which step is repeated as necessary, to attain an alloy exhibiting the above recited physical properties.

* * * * *